US007578032B2

(12) United States Patent
Chen

(10) Patent No.: US 7,578,032 B2
(45) Date of Patent: Aug. 25, 2009

(54) ANGLE-LIMITING HINGE

(75) Inventor: Po-Chuan Chen, Shulin (TW)

(73) Assignee: Shin Zu Shing Co., Ltd., Taipei Hsien (TW)

( * ) Notice: Subject to any disclaimer, the term of this patent is extended or adjusted under 35 U.S.C. 154(b) by 106 days.

(21) Appl. No.: 11/973,181

(22) Filed: Oct. 5, 2007

(65) Prior Publication Data

US 2009/0089977 A1 Apr. 9, 2009

(51) Int. Cl.
*E05D 11/06* (2006.01)

(52) U.S. Cl. ..... 16/374; 16/387; 16/342

(58) Field of Classification Search ..... 16/342, 16/340, 337, 374, 387
See application file for complete search history.

(56) References Cited

U.S. PATENT DOCUMENTS 4,408,799 A * 10/1983 Bowman ..... 297/354.12
6,286,187 B1 * 9/2001 Chang ..... 16/340
6,813,812 B2 * 11/2004 Lu et al. ..... 16/342
7,036,187 B2 * 5/2006 Rude ..... 16/342
2006/0191104 A1 * 8/2006 Cho et al. ..... 16/340
2006/0288535 A1 * 12/2006 Lu et al. ..... 16/387

* cited by examiner

*Primary Examiner*—Lynda Jasmin
*Assistant Examiner*—Michael Lee
(74) *Attorney, Agent, or Firm*—William E. Pelton, Esq.; Cooper & Dunham LLP

(57) ABSTRACT

An angle-limiting hinge has a stationary leaf, a pivoting leaf, a pintle and a limiting element. The pintle is mounted statically in the stationary leaf and rotatably in the pivoting leaf, thereby allowing the leaves to rotate relative to each other and the pintle has a limit. The limit is C-shaped, formed diametrically around the pintle and comprises two ends being positive stops. The limiting element is mounted around the pintle and is secured to the pivoting leaf and has a limiting block mounted securely in the limiting element using riveting. The limiting block is disposed between the positive stops of the limit to limit relative rotational angles of the leaves. Accordingly, the angle-limiting hinge fastens and facilitates fabrication and is capable of limiting the rotational angle of the leaves.

4 Claims, 4 Drawing Sheets

ANGLE-LIMITING HINGE

BACKGROUND OF THE INVENTION

1. Field of the Invention

The present invention relates to hinges, and more particularly to an angle-limiting hinge that facilitates fabrication and is capable of limiting a rotational angle of a cover relative to a base of a notebook computer.

2. Description of Related Art

Notebook computers are widely used by people for various applications and uses and comprises a cover, a base and at least one hinge. The hinge is mounted between the cover and the base to allow relative rotation of the cover and the base and allow the cover to cover the base to reduce a footprint of the notebook and raise portability.

However, due to frequent opening and closing, the conventional hinge is susceptible to wear and requires complex metallic assembly wherein errors may occur leading to defective hinges, and stages may be slowed by overly complex or unreliable procedures. The complex metallic assembly is further complicated when rotational angle-limit functions are integrated into hinge design.

To overcome the shortcomings, the present invention provides an angle-limiting hinge to obviate or mitigate the aforementioned problems.

SUMMARY OF THE INVENTION

The main objective of the present invention is to provide an angle-limiting hinge that facilitates fabrication and is capable of limiting a rotational angle of a cover relative to a base of a notebook computer.

To achieve the objective, the angle-limiting hinge in accordance with the present invention comprises a stationary leaf, a pivoting leaf, a pintle and a limiting element.

The leaves are attached respectively to the cover and the base of the notebook computer.

The pintle is mounted statically in the stationary leaf and rotatably in the pivoting leaf thereby allowing the leaves to rotate relative to each other and the pintle has a limit. The limit is C-shaped, formed radially around the pintle and comprises two end being positive stops.

The limiting element is mounted around the pintle and is secured to the pivoting leaf and has a limiting block mounted securely in the limiting element using riveting. The limiting block is disposed between the positive stops of the limit to limit the rotational angle limiting element, the leaves, and the cover.

Accordingly, the angle-limiting hinge fastens and facilitates fabrication and is capable of limiting the rotational angle of the leaves.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
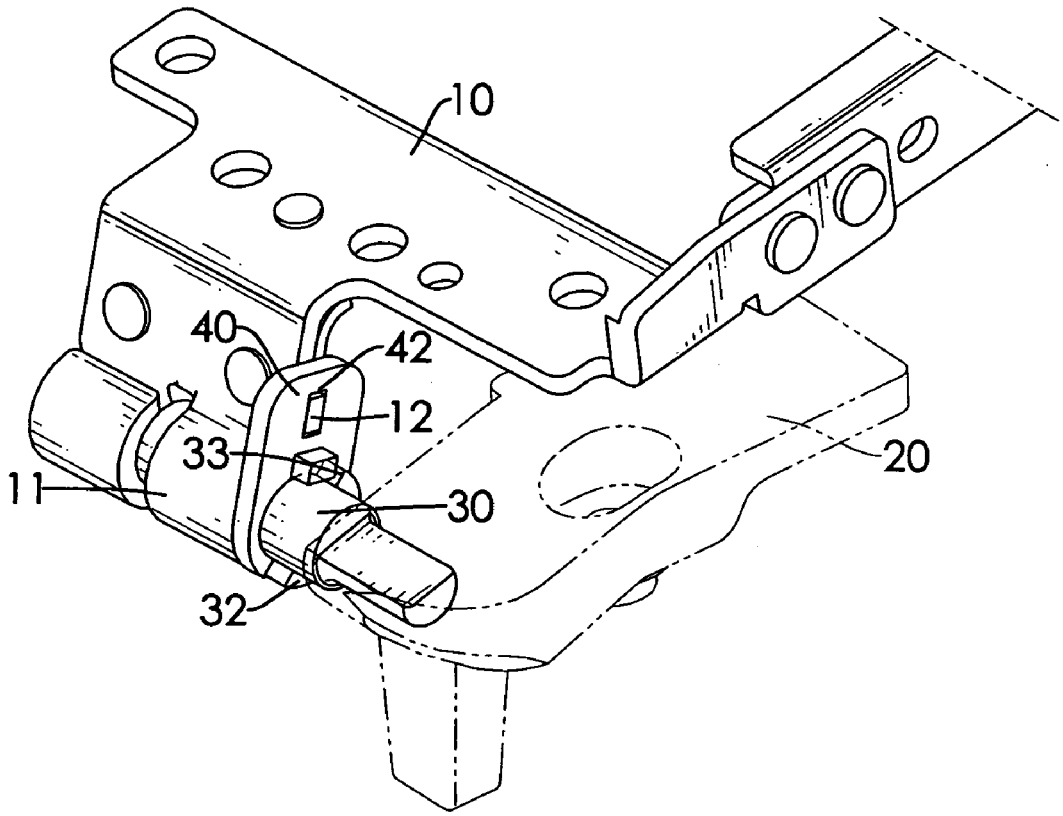
FIG. 1 is a perspective view of an angle-limiting hinge in accordance with the present invention.
Figure 2:
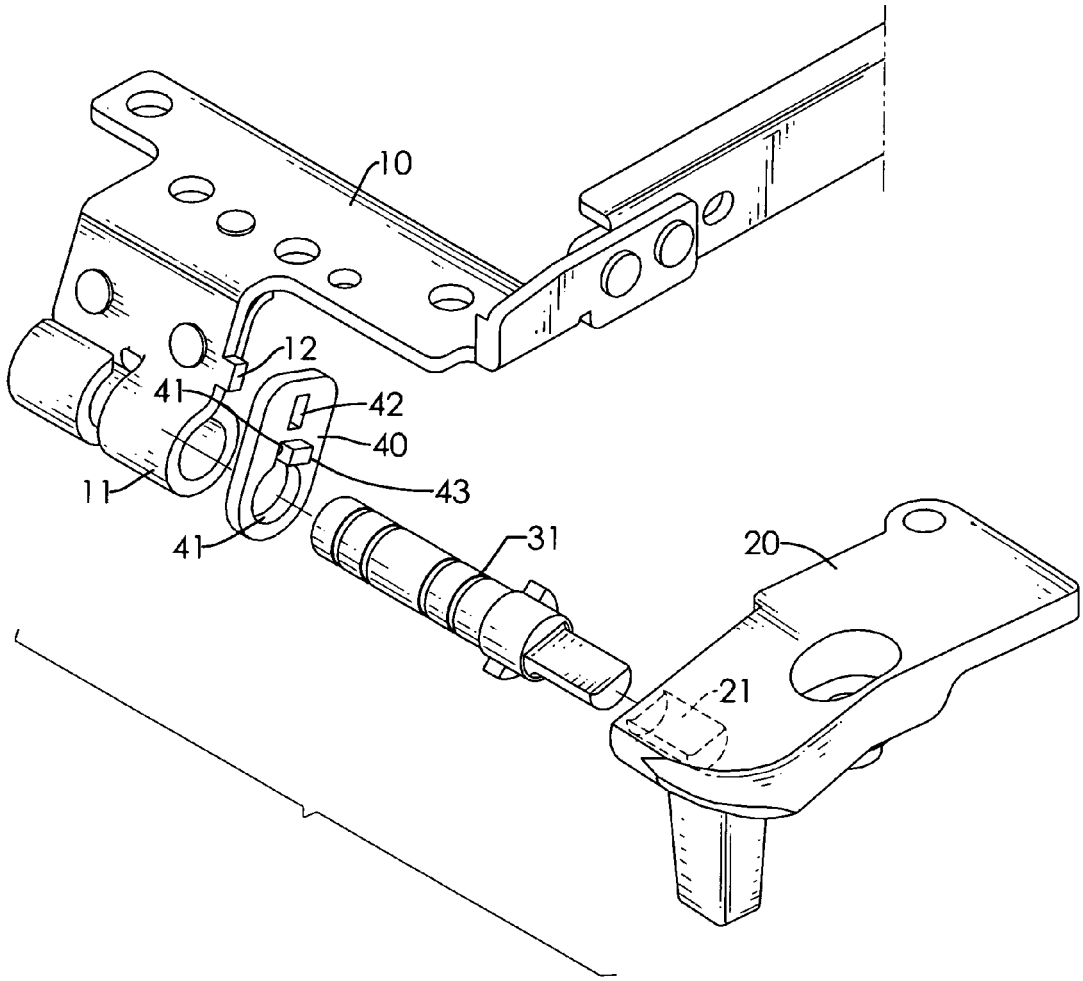
FIG. 2 is an exploded perspective view of the angle-limiting hinge in FIG. 1.

With reference to FIGS. 1 and 2, an angle-limiting hinge in accordance with the present invention comprises a pivoting leaf (10), a stationary leaf (20), a pintle (30) and a limiting element (40).

The pivoting leaf (10) is attached to a cover of a notebook computer and has a bottom, a side edge, at least one sleeve (11) and an engaging protrusion (12). The sleeve (11) is formed at the distal end of the pivoting leaf (10) and each sleeve (11) has an inner surface. The engaging protrusion (12) protrudes from the side edge of the pivoting leaf (10) adjacent to one of the at least one sleeve (11).

The stationary leaf (20) is attached to a base of the notebook computer and has a side surface and a mounting hole (21). The side surface faces the side edge of the pivoting leaf (10). The mounting hole (21) is defined in the side surface of the stationary leaf (20) and is non-circular in cross section.

The pintle (30) has a mounting end, a pivoting portion, multiple grooves (31) and a limit (32). The mounting end of the pintle (30) is non-circular in cross section, corresponds to and is mounted statically in the mounting hole (21) of the stationary leaf (20). The pivoting portion is mounted tightly through the at least one sleeve (11) of the pivoting leaf (11) is held by and rubs against the inner surface of the at least one sleeve (11) to generate friction to hold the pivoting leaf (10) in various positions. The grooves (31) are formed circumferentially around the pivoting portion of the pintle (30) for containing a lubricant, thereby preventing attrition and increasing smoothness of rotation. The limit (32) is C-shaped in cross section and has two ends being positive stops (33) and is formed radially around the pintle (30).

Figure 3:
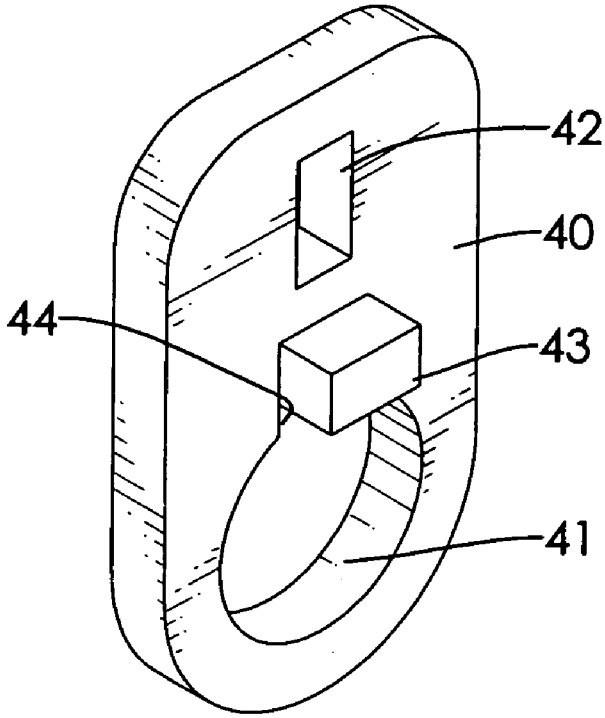
FIG. 3 is an enlarged perspective view of a limiting element of the angle-limiting hinge in FIG. 2.

With further reference to FIG. 3, the limiting element (40) is mounted around the pintle (30) and has a through hole (41), a riveted notch (44), an engaging hole (42) and a limiting block (43).

Figure 4:
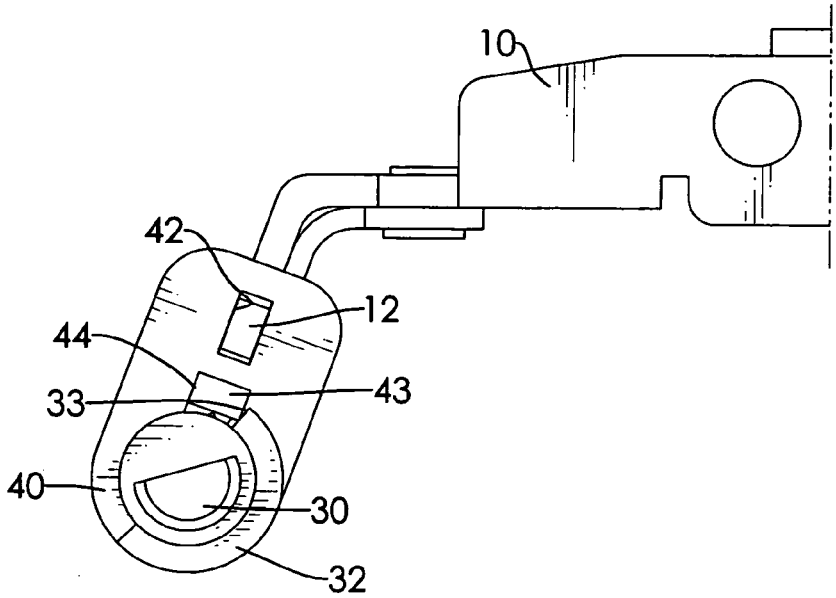
FIG. 4 is an operational side view of the angle-limiting hinge in FIG. 1.
Figure 5:
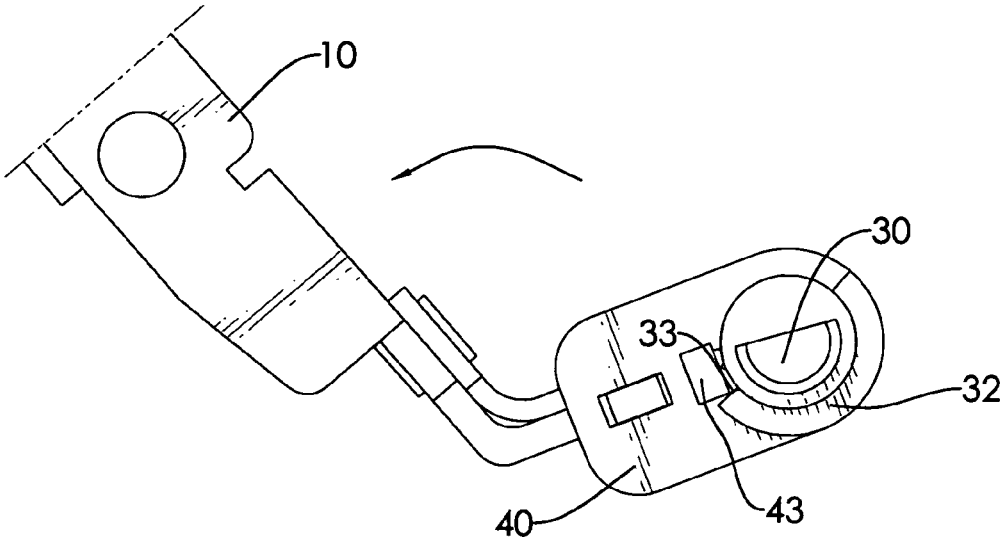
FIG. 5 is an another operational side view of the angle-limiting hinge in FIG. 1.

The through hole (41) is formed through the limiting element (40), aligns with the sleeve (11) of the pivoting leaf (10) and is mounted around the pintle (30) to allow full rotation. The riveted notch (44) is defined through the limiting element (40), is adjacent to and communicates with the through hole (41). The engaging hole (42) is formed through the limiting element (40), corresponds to and is mounted securely on the engaging protrusion (12) of the pivoting leaf (10), thereby forces the limiting element (40) to rotate simultaneously with the pivoting leaf (10). The limiting block (43) is attached securely in riveted notch (44) of the limiting element (40) in a riveting manner and the limiting block (43) protrudes from the limiting element (40) and is disposed between the positive stops (33) of the limit (32). With further reference to FIGS. 4 and 5, when the pivoting leaf (10) rotates relative to the stationary leaf (20), the limiting block (43) of the limiting element (40) moves between the positive stops (33) of the limit (32) and alternatively abuts the ends of the limit (32). Therefore, the rotational angle of the limiting element (40), the leaf secured to the limiting element (40) and the cover attached thereto is limited.

Since the limiting element (40) is riveted into the riveting notch (44), speed of production is rapidly increased whilst complexity of production is reduced, thereby raising productivity by increasing output and reducing rejection and defect rates. Furthermore, by changing size of the limiting element (40), the hinge can be tailored to various customers needs simply with little or no machine alteration or component redesign. This further reduces end product cost.

Even though numerous characteristics and advantages of the present invention have been set forth in the foregoing description together with details of the structure and function of the invention, the disclosure is illustrative only. Changes may be made in detail especially in matters of shape, size and arrangement of parts within the principles of the invention to the full extent indicated by the broad general meaning of the terms in which the appended claims are expressed.

What is claimed is:

1. An angle-limiting hinge comprising:

a pivoting leaf having a distal end;

a side edge;

at least one sleeve being formed on the bottom of the pivoting leaf and having an inner surface; and an engaging protrusion protruding from the side edge of the pivoting leaf adjacent to one of the at least one sleeve;

a stationary leaf having a side surface facing the edge of the pivoting leaf;

a pintle having a mounting end mounted securely in the stationary leaf;

a pivoting portion being mounted tightly through the at least one sleeve of the pivoting leaf, being held by and rubbing against the inner surface of the at least one sleeve to generate a friction; and a limit being C-shaped in cross section, formed radially around the pintle and having two ends being positive stops; and a limiting element being mounted around the pintle and having a through hole being formed through the limiting element, aligning with the at least one sleeve of the pivoting leaf and being mounted around the pintle;

a riveted notch being defined through the limiting element, adjacent to and communicating with the through hole;

an engaging hole being formed through the limiting element, corresponding to and being mounted securely on the engaging protrusion of the pivoting leaf; and a limiting block being attached securely in the riveted notch of the limiting element and protruding from the limiting element and being disposed between the positive stops of the limit for limiting a rotation between the pivoting leaf and the stationary leaf.

2. The angle-limiting hinge as claimed in claim 1, wherein the limiting block is mounted securely in riveted notch of the limiting element.

3. The angle-limiting hinge as claimed in claim 1, wherein the stationary leaf further has a mounting hole being defined in the side surface of the stationary leaf and being non-circular in cross section; and the mounting end of the pintle is non-circular in cross section, corresponds to and is mounted statically in the mounting hole of the stationary leaf.

4. The angle-limiting hinge as claimed in claim 1, wherein the pintle further has multiple grooves being formed circumferentially around the pivoting portion of the pintle for containing a lubricant.

* * * * *